US005127351A

United States Patent [19]

Breems

[11] Patent Number: 5,127,351

[45] Date of Patent: Jul. 7, 1992

[54] BATTEN END FITTING

[76] Inventor: Martinus V. Breems, 571 Riverside Ave., Westport, Conn. 06880

[21] Appl. No.: 641,775

[22] Filed: Jan. 16, 1991

[51] Int. Cl.[5] ..... B63H 9/10

[52] U.S. Cl. ..... 114/102; 114/112; 114/98

[58] Field of Search ..... 114/39.1, 97, 98, 99, 114/102, 103, 108, 112

[56] References Cited

U.S. PATENT DOCUMENTS 294,980 3/1884 Field ..... 114/112

4,823,720 4/1989 Foster ..... 114/103

*Primary Examiner*—Edwin L. Swinehart

*Attorney, Agent, or Firm*—Epstein, Edell & Retzer

[57] ABSTRACT

A batten end fitting includes a coupling having slots therein for securely receiving slides mounted for movement in a mast track formed longitudinally in a mast and rollers rotatably mounted thereon for movement along the mast in response to movement of the slides. A socket or pivot is formed in the coupling, and a ball is defined on the forward end of a batten holder for rotatable engagement with the socket when the batten holder is flexibly secured to the coupling. The batten holder includes a pair of plates for receiving therebetween a luff end of a mainsail, and a positioner is slidably mounted between the plates for receiving a forward end of a batten sewn into a pocket in the mainsail. The positioner selectively positions the batten relative to the plates and thereby selectively tensions the batten within the batten pocket. The ball on the batten holder being rotatable in the coupling socket allows the batten to rotate relative to the coupling to eliminate torque friction between the slides and the mast. The rollers on the coupling absorb forward thrust of the batten in the direction of the mast to eliminate pressure friction between the slide and the mast.

19 Claims, 2 Drawing Sheets

BATTEN END FITTING

BACKGROUND OF THE INVENTION

1. Field Of The Invention

The invention pertains to a fitting for the luff end of a full batten mainsail and, more particularly, to a batten end fitting for eliminating friction between the forward end of a batten and a mast of a sailboat.

2. Description of the Prior Art

Full batten mainsails typically utilize battens of relatively rigid material, such as fiberglass, wood and the like, positioned in pockets sewn in the mainsail to extend generally horizontally in spaced parallel relation from the leech, or trailing end, to the luff, or forward end, of the mainsail. Sail slides are commonly secured by webbing to the luff of the sail directly in front of or below and/or above the battens for sliding movement in a track formed longitudinally in the mast to position the luff in spaced, generally parallel relation with the mast and permit raising and lowering of the mainsail when the sail slides are slid in the mast track. The battens provide numerous benefits including retaining the shape of the sail in a variety of wind conditions, prolonging the life of the sail by reducing flogging in high wind or head to wind conditions, allowing the sail to flake more quickly and easily when lowered on a boom, and enhancing sailing performance by supporting sails having relatively larger roach areas. However, full batten mainsails possess various disadvantages in that the battens exert torque and compression forces on the sail slides creating friction that impedes raising and lowering of the sail. Twisting of the battens when the sail is raised and lowered can lock the sail slides in the mast track and lead to breakage of the sail slides. Additionally, the roach of the sail thrusts the battens forwardly toward the mast compressing the sail slides in the mast track to produce friction between the sail slides and the mast, and this friction is relatively greater for sails having large roach areas. Moreover, the forward end of the battens can move laterally past the sail slides and inwardly toward the mast, and can hit the mast and/or jam the bolt rope. It is also frequently desirable to adjust the tension of the battens between the leech and the luff of the mainsail to vary the draft of the sail, and webbing with straps, buckles, lacing strips, VELCRO ® and the like is usually employed on the mainsail to selectively tension, or bow, the battens within the mainsail pockets. Such webbing is generally complex, substantially increases the cost of the mainsail, makes it difficult to adjust batten tension from the luff end of the sail, where it is most convenient, and tends to wear out in a relatively short time due to the loads exerted by the battens being applied against the webbing.

Various fittings for full batten mainsails have been proposed, and illustrative fittings are shown in U.S. Pat. Nos. 4,823,720 to Foster; 3,092,064 to Benedict; 591,446 to Worthen and 259,209 to Rand. Most batten end fittings attempt to reduce friction between slides at the forward end of the battens and the mast by coupling the forward end of the battens to such slides with joints that permit limited movement of the battens relative to the slides. Such joints typically do not permit the battens to pivot, or rotate, around a horizontal axis coincident with the longitudinal axis of the battens, a vertical axis parallel to the mast as well as an axis perpendicular to both the horizontal and vertical axes. These joints do not allow universal movement of the battens with respect to the slides, and friction between the slides and the mast under torque and compressive loads is only partially ameliorated. Joints that do permit the battens to rotate around axes in three planes relative to the slides generally require complex, rigid mechanical connectors having multiple, relatively rotatable parts between the forward end of the battens and the slides. The rigid connectors must be mounted on specialized slides integral with the connectors themselves and, therefore, cannot accommodate the diverse variety of conventional sail slides presently available for use in mast tracks on sailboats. Furthermore, such rigid connectors fail to eliminate friction of the slides in the mast track due to forward thrust of the battens and permit only a limited range of batten motion around the respective axes. Connectors of the latter type also do not permit batten tension to be adjusted easily from the luff end, are generally prohibitively expensive and usually incorporate exposed metal parts that can damage the mast and adjacent rigging.

Batten end fittings including a slider movable in a mast track and having rollers for riding along the outer surface of the mast to reduce friction between the slider and the mast from pressure loads have also been proposed, and illustrated fittings are the "Pressure Absorbing Slides" made by Rutgerson, a Swedish corporation. Such fittings are highly customized, employing particularly configured sliders that are integral with the rollers and necessitate specialized mast tracks. Moreover, the rollers are relatively small, are not ball bearing mounted and fail to eliminate all of the friction generated between the slider and the mast. The joints coupling the forward ends of the battens to the sliders are not universal joints and, therefore, allow only limited batten motion. Additionally, these fittings are extremely expensive due to the required customization, incorporate complex batten tensioners that render batten tension adjustment difficult and cumbersome and possess many of the deficiencies noted above. Batten end fittings utilizing linear ball bearing rollers in conjunction with a universal joint have also been proposed, and fittings of this type are the "Battcar" fittings sold by Harken Corporation. A significant disadvantage to these batten end fittings is that a track must be installed on the outer surface of the mast to mount the fittings thereon, and a system of specialized headboard cars, luff cars and end stops must be utilized with this track. Consequently, this system is not cost-effective and possesses the further drawback of failing to provide capabilities for batten tension adjustment from the luff end of the mainsail.

A deficiency shared by presently available end fittings characterized by slides integral with rollers or wheels is that the fittings can get caught in the "gates", i.e. openings formed in the mast along the mast track to permit positioning of the sail slides therein, when the sail is raised and lowered. Furthermore, conventional mainsails utilize additional sail slides webbed to the luff end of the mainsails between the batten end fittings for sliding movement in the mast track, and the batten end fittings and sail slides together form a relatively high stack when the sail is stacked upon the boom. It is desirable that the mainsail be stacked upon the boom compactly to bring the headboard closer to the deck, and conventional batten end fittings do not accommodate the sail slides to reduce the height of this stack.

SUMMARY OF THE INVENTION

Accordingly, it is an object of the present invention to overcome the above disadvantages of prior art batten end fittings and batten tensioners.

Another object of the invention is to provide a batten end fitting disposed between the forward end of a batten and a sail slide mounted in a mast track to eliminate torque and pressure friction between the sail slide and the mast.

A further object of the invention is to provide a batten end fitting suitable for coupling to conventional sail slides.

Yet another object of the invention is to provide a batten end fitting utilizing a universal ball and socket joint between the forward end of a batten and a sail slide slidably mounted in a mast track.

It is also an object of the invention to provide a batten end fitting incorporating ball bearing rollers slidable along the outer surface of a mast in response to movement of sail slides mounted in a mast track to eliminate friction due to pressure loads on the sail slides.

A still further object of the invention is to provide a batten end fitting for the luff end of a batten permitting tension of the batten to be selectively adjusted at the luff end.

An additional object of the invention is to provide a batten end fitting to be disposed at the luff end of a mainsail between additional, conventional sail slides and being capable of accommodating a portion of the additional sail slides within the fitting when the mainsail is stacked.

In addition to the foregoing objects, the batten end fitting of the present invention possesses the advantages of employing a simple, non-rigid universal joint, not requiring a specialized headboard or sail slides, being suitable for use with the diverse sail slides on existing sailboats, preventing undesirable forward movement of a batten past the fitting, avoiding being caught on the "gates" in existing masts, permitting easy adjustment of batten tension, presenting no exposed metal parts and being uncomplicated in construction and highly cost-effective.

Accordingly, the present invention is characterized by a batten holder including a pair of plates for receiving therebetween a luff end of a mainsail and a positioner disposed between the plates for receiving the luff end of a batten sewn into a pocket in the mainsail. The positioner is mounted between the plates in longitudinal alignment with the batten, and is selectively, slidably movable relative to the plates to adjust the tension of the batten in the mainsail pocket to vary the draft of the sail. A coupling for joining the batten holder to conventional sail slides slidably mounted in a mast track formed longitudinally in a mast includes a body having a tapered socket formed therein for alignment with a ball defined on the forward end of the plates when the holder is secured to the coupling by a flexible line. Slots formed in the coupling receive a pair of conventional sail slides for securement to the coupling by the flexible line, and the ball on the batten holder being secured relative to the socket in the coupling permits the batten to rotate relative to the coupling around axes in three distinct planes to eliminate torque friction between the sail slides and the mast when the sail is raised and lowered. Rollers are provided on the coupling for movement along an outer surface of the mast in response to movement of the slides, and these rollers absorb pressure loads produced by forward thrust of the battens in the direction of the mast and thereby position the slides for unrestricted movement in the mast track even when such loads are applied. A channel is defined in the coupling to be disposed adjacent the mast, whereby additional, conventional sail slides mounted in the mast track and attached to the luff end of the sail above and below the batten can move into the channel when the sail is stacked to reduce the size of this stack.

Other objects and advantages of the present invention will become apparent from the following description of the preferred embodiments taken in conjunction with the accompanying drawings.

DESCRIPTION OF THE PREFERRED EMBODIMENT

Figure 1:
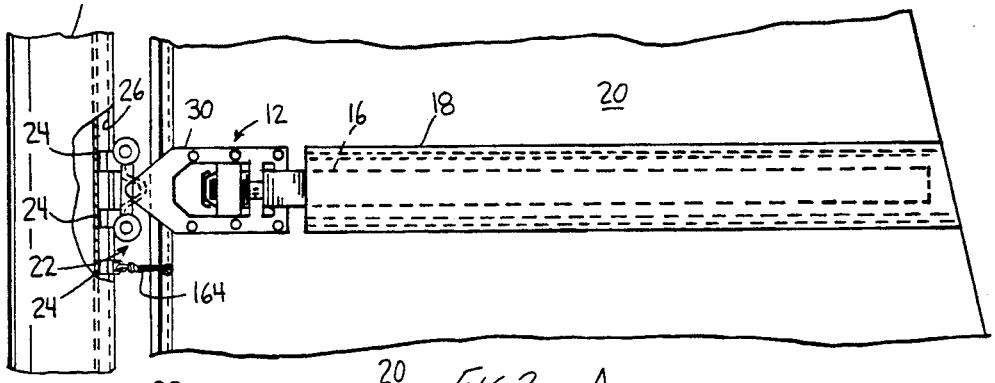
FIG. 1 is a side plan view of the batten end fitting according to the present invention.
Figure 2:
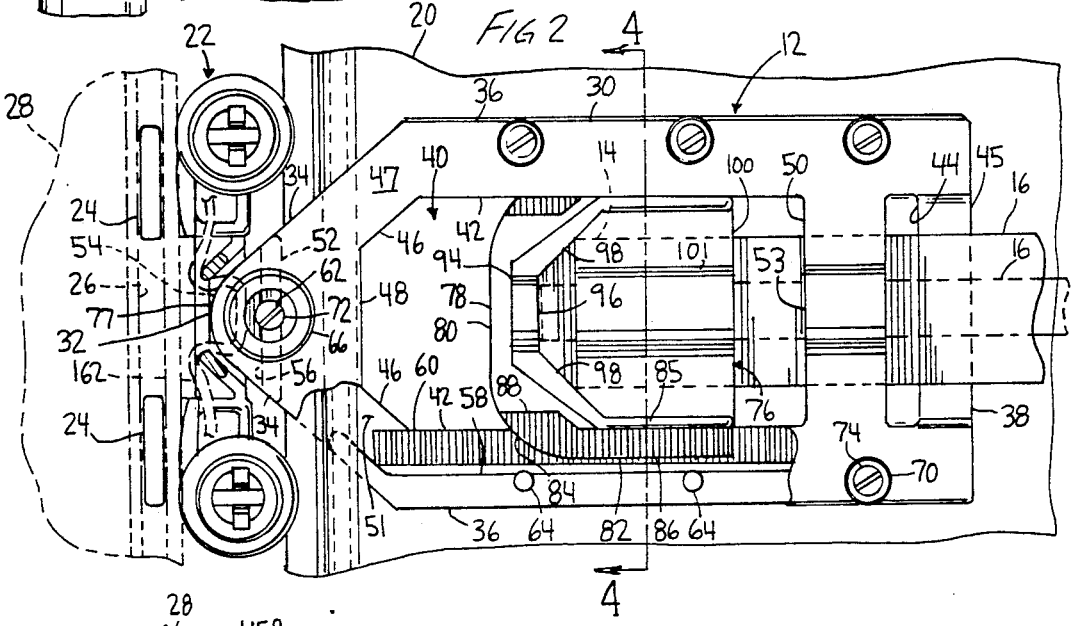
FIG. 2 is a side view, partly in section, of the batten end fitting of FIG. 1.
Figure 3:
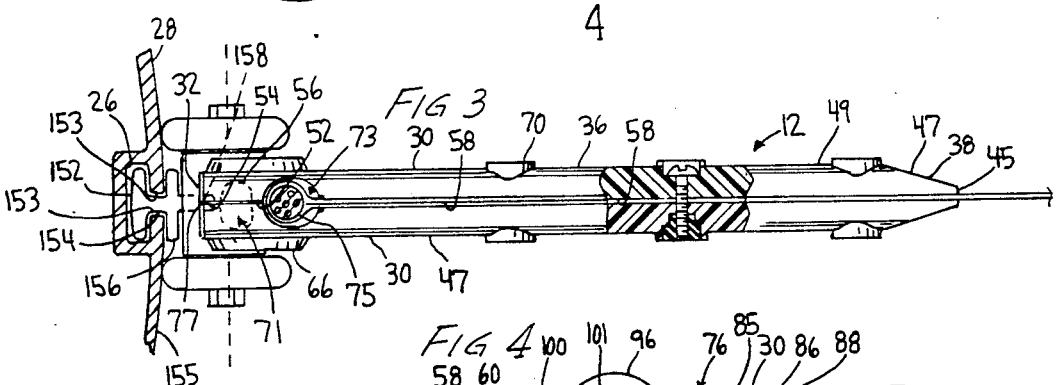
FIG. 3 is a top view, partly in section, of the batten end fitting of FIG. 1.
Figure 4:
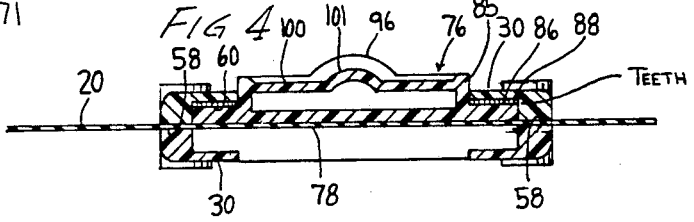
FIG. 4 is a sectional view taken along line 4—4 of FIG. 2.

As shown in FIGS. 1–6, the batten end fitting 10 of the present invention includes a batten holder 12 receiving the forward or luff end 14 of a batten 16 disposed in a pocket 18 sewn in a mainsail 20, and a car or coupling 22 for connecting the holder 12 to a pair of conventional sail slides 24 slidably mounted in a mast track 26 formed longitudinally in a mast 28 of a sailboat. As illustrated in FIGS. 2–4, the holder 12 includes a pair of generally flat plates 30, each having a rounded forward nose 32, a pair of opposing symmetrical arms 34 extending angularly rearwardly from the nose 32, a pair of spaced, parallel legs 36 extending longitudinally from the arms 34, respectively, and a web 38 perpendicularly joining the legs 36. A central opening or window 40 is defined in the plates 30 by parallel longitudinal edges 42 along the legs 36, a rearward vertical edge 44 along the web 38, angled edges 46 along the arms 34 and a forward vertical edge 48 joining the angled edges 46 disposed parallel to the rearward vertical edge 44. The thickness of the web 38 tapers from the rearward vertical edge 44 to an end surface 45, such that the web 38 is of maximum thickness along the rearward vertical edge 44 and of reduced thickness along the end surface 45 and an outer face 47 of the web 38 is angularly recessed with respect to an outer face 49 of the legs 36. A bridge 50 joined to the legs 36 extends transversely between the parallel edges 42 across the opening 40 parallel to and spaced forwardly from the web 38 and includes an arch 53 disposed centrally between the parallel edges 42. An inner face 51 of the plates 30 has a raised ledge 52 formed thereon across the nose 32 generally parallel to the forward vertical edge 48, and a curved projection 54 is formed on the inner face forwardly of the ledge 52 to define an elongated groove 56 therebetween. An upstanding shoulder 58 is formed on the inner face 51 to extend along the outermost edges of the legs 36 spaced outwardly from and parallel to the edges 42 and partly along the outermost edges of the arms 34 spaced outwardly from and parallel to the edges 46. The inner face 51 along the web 38 is disposed co-planar with the shoulder 58, and serrations 60 are formed on the inner face 51 to extend longitudinally on the legs 36 adjacent the shoulder 58 from the arms 34 to the web 38. A bore 62 is formed centrally through the nose 32 to extend through the ledge 52 medially positioned on the longitudinal length thereof, and circular holes 64 are formed through the legs 36 at spaced longitudinal locations therealong, such that the circumference of the holes 64 extends partly into the shoulders 58 as shown in FIG. 2. A raised annular rim 66 is provided on the outer face 47 of the plates 30 around the bores 62, and raised annular rims 70 are similarly provided on the outer face 47 around the holes 64. A screw 72 is insertable into the aligned bores 62 and screws 74 are insertable into the aligned holes 64 of the plates 30 when the projections 54, the ledges 52 and the shoulders 58 are positioned in abutting overlapping alignment to secure the plates together with the mainsail 20 disposed therebetween via the screws 74 passing through the mainsail 20 as shown in Figs. 2 and 3. When so secured, the grooves 56 together define a through passage 71, the ledges 52 and the shoulders 58 define therebetween an opening 73 for receiving a luff 75 of the mainsail 20 and the noses 32 together define a rotatable ball 77.

A batten positioner or tensioner 76 to be selectively positioned between the plates 30 over a surface of the mainsail 20 includes a substantially flat base 78 to extend transversely between the legs 36 and having a straight forward edge 80 and opposing, parallel side edges 82 joined to the forward edge 80 by curved edges 84. Raised shoulders 85 are provided on the base 78 inwardly of and parallel to the side edges 82, and side flanges 86 are defined between the side edges 82 and the shoulders 85 for positioning between the legs 36 of the plates 30 in overlapping abutment with the inner face 51 when the side edges 82 are positioned adjacent the shoulders 58 as shown in FIGS. 2 and 3. Serrations 88 are provided on the side flanges 86 to extend longitudinally therealong and partly along the curved edges 84 for engaging the serrations 60 when the side flanges are positioned between the plates 30. A raised end stop 94 projects upwardly from an outer surface of the base 78 and is defined by a central ridge 96 having an arched configuration disposed parallel to the forward edge 80 and ridges 98 extending angularly rearwardly from the ridge 96 for abutting engagement with the angularly tapered forward end 14 of the batten 16. A bridge 100 joined to the shoulders 85 extends over the base 78 transversely to the side edges 82 and includes an arch 101 in longitudinal alignment with the arched ridge 96 to be longitudinally aligned with the arch 53 when the positioner 76 is secured between the plates 30 via tightening of the screws 74.

Figure 5:
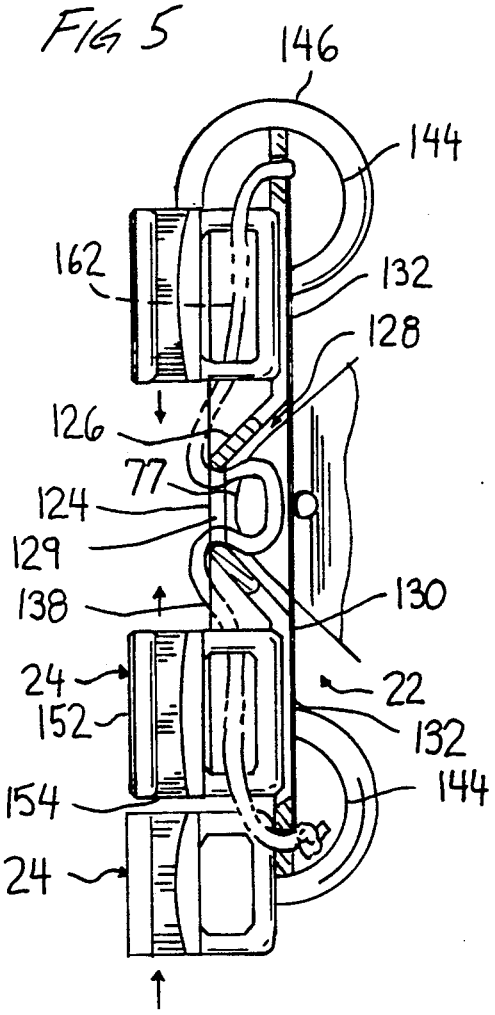
FIG. 5 is a longitudinal view of the batten end fitting of FIG. 1.
Figure 6:
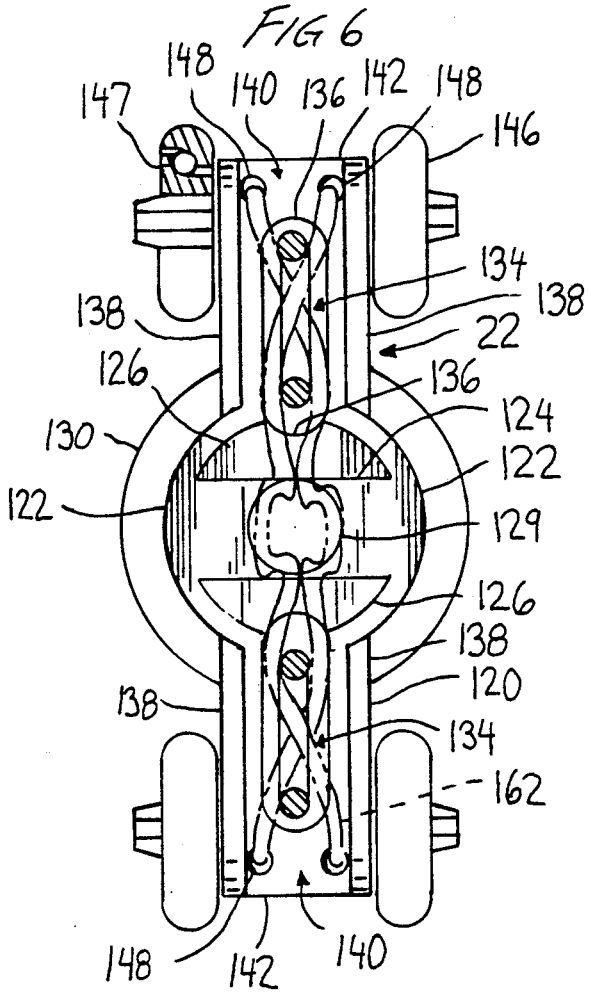
FIG. 6 is a back view, partly in section, of the batten end fitting of FIG. 1.

As shown in FIGS. 5 and 6, the car or coupling 22 includes a body 120 having a pair of symmetrical, spaced, semi-circular side walls 122, a flat, central bottom wall 124 extending diametrically between the side walls 122 and sloping bottom walls 126 angularly joined to opposite sides of the central bottom wall 124 and extending outwardly therefrom to join the side walls 122 and define a tapered socket or pivot 128 for receiving the ball 77 on the batten holder 12. A circular hole 129 is formed centrally in the bottom wall 124, and the socket 128 is bordered by a flat rim 130 of uniform thickness. The rim 130 extends perpendicularly from the side walls 122 parallel thereto, and opposing, generally rectangular side flanges 132 extend radially outwardly from the rim 130 co-planar therewith at 180° spaced locations, such that the longitudinal axes of the flanges 132 are longitudinally aligned and are oriented perpendicular with a longitudinal axis of the central bottom wall 124. An elongated slot 134 having opposing curved ends 136 is formed in each of the flanges 132, and the slots 134 are disposed in the flanges 132 in longitudinal alignment along the longitudinal axes of the flanges 132 such that a curved end 136 extends into each of the sloping bottom walls 126. Spaced, parallel flange walls 138 depend from a lower surface of each of the flanges 132 to extend along lateral side edges of the flanges, and the flange walls 138 are joined to the semicircular side walls 122 such that a lower surface of the side walls 122 is co-planar with a lower surface of the flange walls 138. A channel 140 is defined in each flange 132 between the flange walls 138 as shown in FIG. 6. A curved projection 144 is provided on an upper surface of the flanges 132 to be positioned adjacent an end wall 142 on the flanges 132 co-planar with outer surfaces of the flange walls 138. Rollers or bearings 146 are mounted by ball bearings 147 on the flange walls 138 adjacent the projections 144, such that the rotational axes for the rollers 146 are disposed parallel to the longitudinal axis of the bottom wall 124 and the rollers 146 of each flange 132 are aligned on a common rotational axis. A pair of laterally aligned holes 148 are formed through each of the flanges 132 to be positioned medially between the slots 134 and the end walls 142, and each hole 148 is positioned adjacent a projection 144.

Figure 7:
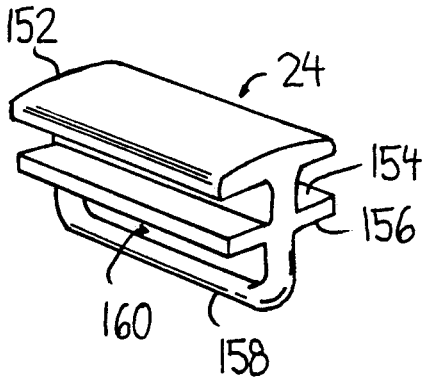
FIG. 7 is a perspective view of a sail slide for use with the batten end fitting of FIG. 1.

Sail slides 24 to be coupled to the forward end 14 of the batten 16 via the coupling 22 are conventional in design for use in mast tracks on sailboats and a sail slide 24 is illustrated by way of example only in FIG. 7. The slide 24 includes a foot 152 to be mounted for sliding movement in the mast track 26, a connecting web 154 joined perpendicularly to the foot 152 to extend centrally along the longitudinal length thereof for engagement between opposing edges 153 of the mast 28, and a retaining flange 156 joined to the connecting web 154 to be disposed in spaced, generally parallel relation with the foot 152 for extending over an outer surface 155 of the mast 28 to retain the foot 152 in the mast track 26 as shown in FIGS. 2 and 3. A loop 158 is provided on the retaining flange 156 to extend outwardly therefrom in vertical alignment with a central longitudinal axis of the retaining flange 156 and defines a loop opening 160 contained in a plane perpendicular with the retaining flange 156 for receiving a flexible securing line 162 to secure the slide 24 within the channel 140 of the coupling 22 when the loop 158 is positioned in the slot 134. Additional sail slides 24' are also typically provided above and/or below the battens 16, and such slides ar mounted for sliding movement in the mast track 26 via the feet 152 and are attached to the luff 75 of the mainsail 20 via webbing 164 passed through the loop 158 as shown in FIG. 1.

Preferably, the plates 30 are fabricated as unitary, integral moldings of plastic, and the positioner 76 is also made as a unitary, integral plastic molding. The coupling 22 is preferably fabricated as a unitary, integral molding of plastic, and the rollers 146 are made from plastic and are mounted on the coupling 22 by ball bearings. The longitudinal length of the slots 134 in the coupling 22 is preferably greater than the longitudinal length of the loops 158 to permit movement of the slides 24 relative to the coupling 22. The flexible securing line 162 is preferably made from a length of nylon cord or other relatively strong, water-resistant material. The annular rims 66 and 70 are preferably sized to conceal exposed ends of the screws 72 and 74, and prevent such exposed ends from damaging the mast, rigging and other objects contacting the plates 30.

In operation, the luff end of the mainsail 20 adjacent a batten 16 disposed in a batten pocket 18 sewn in a mainsail 20 is positioned between the plates 30 as shown in FIGS. 1–4, such that the luff 75 of the mainsail 20 is disposed in the opening 73 defined by the plates 30. The window 40 is longitudinally aligned with the forward end 14 of the batten 16, and the forward end 14 is passed over the web 38 into the window 40 and under the bridge 50. The positioner 76 is positioned between a plate 30 and a surface of the mainsail 20 having the batten 16 thereon, such that the side flanges 86 on the positioner 76 are placed in overlapping alignment with the legs 36 of the plates 30. The forward end 14 of the batten 16 is inserted under the bridge 100 of the positioner 76 to abuttingly engage the end stop 94. The screws 72 and 74 are inserted into the holes 62 and 64, respectively, and are passed through the mainsail 20 and tightened by nuts (not shown) to secure the mainsail 20 between the shoulders 58 on the plates 30. Tension of the batten 16 in the batten pocket 18 can be selectively adjusted by loosening the screws 74 to disengage the positioner 76 and manually sliding the positioner 76 forwardly or rearwardly relative to the plates 30, such sliding movement being limited in the forward direction by the forward vertical edge 48 and in the rearward direction by the bridge 50. The positioner 76 can be secured in a desired position by tightening the screws 74 to secure the positioner between the plates 30, and the serrations 88 on the positioner 76 engage the serrations 60 on the inner face 51 of the legs 36 to lock the positioner 76 relative to the plates 30. As shown in FIG. 2, the batten 16 can be flat with an angular forward end 14 for engaging the ridges 96 and 98 on the end stop 94, or a batten 161 can have a circular cross-sectional configuration for engaging the arched ridge 96, and the circular batten 161 is retained by the arches 53 and 101 of the bridges 50 and 100. The loops 158 on conventional mast slides 24 are positioned in the slots 134 in the coupling 22, and the flexible securing line 162 is knotted at one end to permit the free end of the line 162 to be inserted through a hole 148 in the coupling 22 to be passed through this hole from the front to the back surface of the coupling 22. The line 162 is then inserted diagonally through the loop opening 160 on the slide 24 positioned in the adjacent slot 134, and inserted upwardly through the hole 129 in the central bottom wall 124 of the socket 128. The line is then inserted through the passage 71 in the nose 32 of the holder 12 from the bottom end to the top end of the passage 71. The line 162 projecting from the top end of the passage 71 is inserted downwardly through the hole 129 in the bottom wall 124, and thereafter diagonally through the loop opening 160 of the second slide 24 in the second slot 134. From this loop opening, the line 162 is inserted upwardly through the hole 148 in the coupling 22 that is diametrically opposite the hole 18 previously receiving the line 162. The line 162 is then passed downwardly through the adjacent hole 148, is inserted through the loop opening 160 of the adjacent slide 24, and is passed upwardly through the hole 129 for insertion through the passage 71 in the nose 32 of the holder 12 from the top end to the bottom end of the passage 71. The line 162 projecting from the bottom end of the passage 71 is passed downwardly through the hole 129 in the bottom wall 124, is inserted diagonally through the adjacent slide 24, and upwardly through the last remaining hole 148. The end of the line projecting from the hole 148 is then knotted, such knot being positioned adjacent the knot previously formed. The feet 152 on the slides 24 are positioned in the mast track 26 via gates or openings formed in the mast 28 adjacent the mast track 26 at select locations therealong. When the mainsail 20 is raised and lowered, the rollers 146 on the coupling 22 slide along the outer surface 155 of the mast 28 as the slides 24 move upwardly and downwardly within the mast track 26. The ball 77 defined by the forward noses 32 of the batten holder 12 being secured relative to the socket 128 in the coupling 22 via the flexible line 162 produces a ball and socket universal joint between the forward end of the batten 16 and the mast 28. This joint permits the batten 16 to rotate around an axis extending longitudinally through the batten 16, a vertical axis extending parallel to the mast 28 and a horizontal axis disposed perpendicular to both the longitudinal axis of the batten 16 and the vertical axis parallel to the mast 28. In other words, the batten 16 can rotate around axes in three distinct planes, and the range of rotation is approximately 360° around the batten longitudinal axis, greater than 180° around the vertical axis and approximately 180° around the horizontal axis, the range of rotation around the vertical and horizontal axes being limited only by the position of the mast 28. Rotation of the batten 16 relative to the coupling 22 and, therefore, the slides 24, eliminates binding of the slides in the mast track when the batten is twisted and thereby eliminates torque friction between the batten 16 and the mast 28 when the sail 20 is raised and lowered. Pressure friction caused by thrust forces exerted against the mast 28 when the battens 16 are urged forwardly is eliminated by the ball bearing rollers 146 sliding along the mast 28 when the sail is raised and lowered, such that compressive forces exerted by the battens 16 toward the mast 28 are absorbed by the roller—mounted coupling 22 and are not transmitted to the slides 24. The rollers 146, therefore, act as bearings against the mast 28 and position the slides 24 for unrestricted movement in the mast track 26 regardless of pressure or thrust loads applied by the batten 16. Because the loads are primarily directed forwardly toward the mast, there is little strain on the line 162 and the line 162 is not prone to break or wear. The rim 130 around the socket 128 prevents the ball 77 from moving laterally past the socket 128 and then forwardly past the coupling 22 to the mast 28, and thereby prevents the ball 77 from jumping out of the socket 128. The slots 134 in the coupling 22 can accept any conventional slide presently used in mast tracks on sailboats. When the mainsail 20 is lowered and stacked upon a boom, the slides 24 move within the slots 134 toward the socket 128 due to the slots 134 being longer than the loops 158 on the slides 24. The additional slides 24' above and below the batten 16 slide into the channel 140 and move toward the socket 128 as shown in FIG. 5 to reduce the stacked height of the sail when lowered on the boom.

Having described preferred and alternative embodiments of a new and improved batten end fitting, it is believed that other modifications, variations and changes will be suggested to those skilled in the art in view of the teachings set forth herein. It is therefore to be understood that all such variations, modifications and changes are believed to fall with the scope of the present invention as defined by the appended claims.

What is claimed is:

1. A batten end fitting for coupling a batten having a longitudinal axis to a slide mounted for movement along a mast having a longitudinal axis perpendicular to the batten longitudinal axis comprising coupling means for being secured to the slide;

means for holding the batten; and tapered socket means on said coupling means and ball means on said holding means for being flexibly mounted to said socket means whereby said holding means can rotate relative to said coupling means around the batten longitudinal axis, the mast longitudinal axis and an axis perpendicular to the batten and mast longitudinal axes.

2. A batten end fitting as recited in claim 1 wherein said coupling means includes a body and said socket means includes a tapered recess in said body, and further including wall means in said body extending angularly outwardly from said coupling means in the direction of the batten longitudinal axis for defining said recess.

3. A batten end fitting as recited in claim 2 wherein said holding means includes opposing, cooperatively engaging plate means for receiving the batten between said plate means.

4. A batten end fitting as recited in claim 3 further including positioning means mounted between said plate means for sliding movement relative to said plate means in the direction of the batten longitudinal axis for selectively positioning the batten relative to said plate means.

5. A batten end fitting as recited in claim 4 wherein said ball means includes a rounded projection defined on said plate means.

6. A batten end fitting as recited in claim 5 further including cord means for flexibly mounted said ball means to said socket means to align said ball means with said recess.

7. A batten end fitting as recited in claim 6 further including rim means peripherally disposed around said recess for preventing misalignment of said ball means with said recess.

8. A batten end fitting as recited in claim 7 further including an opening extending longitudinally in said plate means along the batten longitudinal axis and bridge means on said plate means extending transversely across said opening for securing the batten between said plate means.

9. A batten end fitting as recited in claim 8 further including serrations on said positioning means and serrated means on said plate means for cooperatively engaging said serrations to secure said positioning means relative to said plate means.

10. A batten end fitting for coupling a luff end of a batten with a pair of slides mounted for movement in a mast track extending longitudinally along a mast comprising car means securable to the slides for moving along the mast in response to movement of the slides;

bearing means on said car means for positioning the slides to move longitudinally in the mast track;

means for retaining the luff end of the batten;

pivot means on said car means for engagement with said retaining means to permit rotation of said retaining means around a first axis parallel to the mast, a second axis extending longitudinally through the batten and a third axis perpendicular to said first and second axes, said pivot means including a circular socket centrally positioned on said car means; and aperture means in said car means disposed on diametrically opposite sides of said socket for receiving the slides.

11. A batten end fitting as recited in claim 10 wherein said bearing means includes a plurality of rollers mounted on said car means to move along the mast adjacent the mast track.

12. A batten end fitting as recited in claim 11 wherein said rollers are mounted on ball bearings.

13. A batten end fitting as recited in claim 12 wherein a pair of rollers is positioned adjacent each of the slides.

14. A batten end fitting as recited in claim 13 further including means for securing said car means to the slides, said securing means including a flexible line engagable with said car means and the slides to secure the slides in said aperture means.

15. A batten end fitting as recited in claim 14 further including means on said retaining means for receiving said flexible line to engage said retaining means with said pivot means.

16. A batten end fitting for coupling a luff end of a batten of a full mainsail to a sail slide disposed adjacent at least one additional sail slide attached to the mainsail, the sail slides being mounted for movement in a track in the mast when the sail is lowered comprising means for holding the luff end of the batten;

means disposed between said holding means and the mast for coupling said holding means to one of the sail slides to permit rotation of said holding means relative to the one sail slide; and channel means in said coupling means for receiving at least a portion of the other sail slide within said channel means when the sail is lowered.

17. A batten end fitting as recited in claim 16 wherein said coupling means includes a body having recess means for rotatably receiving said holding means and said recess means is disposed between said channel means.

18. A batten end fitting as recited in claim 17 wherein said recess means is circular and said channel means is disposed on diametrically opposite sides of said recess means.

19. A batten end fitting as recited in claim 18 wherein said body includes spaced, parallel walls joined to said recess means and said channel means is defined between said walls.

* * * * *